US011059307B2

(12) United States Patent
Momose et al.

(10) Patent No.: US 11,059,307 B2
(45) Date of Patent: Jul. 13, 2021

(54) PRINTING APPARATUS AND MOVING METHOD FOR SUPPORT PORTION

(71) Applicant: SEIKO EPSON CORPORATION, Tokyo (JP)

(72) Inventors: Yoshihiko Momose, Shiojiri (JP); Norihiro Yamashita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/804,842

(22) Filed: Feb. 28, 2020

(65) Prior Publication Data

US 2020/0276840 A1 Sep. 3, 2020

(30) Foreign Application Priority Data

Feb. 28, 2019 (JP) ..... JP2019-035567

(51) Int. Cl.

| | |
|---|---|
| ***B41J 13/00*** | (2006.01) |
| ***B41J 11/06*** | (2006.01) |
| ***B41J 11/00*** | (2006.01) |
| ***B41J 25/304*** | (2006.01) |
| ***B41J 11/42*** | (2006.01) |
| ***B41J 11/02*** | (2006.01) |
| *B41J 3/407* | (2006.01) |

(52) U.S. Cl.

CPC ..... *B41J 13/0045* (2013.01); *B41J 11/02* (2013.01); *B41J 11/06* (2013.01); *B41J 11/42* (2013.01); *B41J 25/304* (2013.01); *B41J 3/4078* (2013.01); *B41J 11/00* (2013.01)

(58) Field of Classification Search

CPC ..... B41J 13/0045; B41J 11/42; B41J 11/02; B41J 11/06; B41J 25/304; B41J 3/4078; B41J 11/00; B41J 11/0095

See application file for complete search history.

(56) References Cited

U.S. PATENT DOCUMENTS

| | | | | |
|---|---|---|---|---|
| 10,625,498 | B2 * | 4/2020 | Martinez | B41J 11/02 |
| 2005/0068400 | A1 * | 3/2005 | Niimi | B41J 3/4078 347/104 |
| 2008/0238978 | A1 * | 10/2008 | Niimi | B41J 3/4078 347/16 |
| 2014/0049589 | A1 | 2/2014 | Moriya et al. | |

FOREIGN PATENT DOCUMENTS

| | | |
|---|---|---|
| JP | 2014-037108 | 2/2014 |

* cited by examiner

*Primary Examiner* — Henok D Legesse
(74) *Attorney, Agent, or Firm* — Workman Nydegger

(57) ABSTRACT

Provided is a printing apparatus including a support portion supporting a medium, a movement unit configured to move the support portion in a movement direction, a printing unit configured to perform printing on the medium when the support portion is in a printing region, and a control unit configured to control movement of the support portion. The movement unit includes a belt movement mechanism configured to move the support portion by rotating an endless belt, and a linear movement mechanism configured to move the support portion with a linear motor. The control unit moves the support portion with the linear movement mechanism when the support portion moves in the first range with the printing unit performing printing on the medium and moves the support portion with the belt movement mechanism when the support portion moves within the second range.

7 Claims, 8 Drawing Sheets

PRINTING APPARATUS AND MOVING METHOD FOR SUPPORT PORTION

The present application is based on, and claims priority from JP Application Serial Number 2019-035567, filed Feb. 28, 2019, the disclosure of which is hereby incorporated by reference herein in its entirety.

BACKGROUND

1. Technical Field

The present disclosure relates to a printing apparatus and a moving method for a support portion.

2. Related Art

Printing apparatuses of various configurations have been used. One known printing apparatus is configured to form an image while moving a support portion that supports a medium. For example, JP-A-2014-37108 discloses an inkjet recording device including a mobile body having a tray that supports a target recording medium. The injket recording device forms an image while moving the mobile body by rotating an endless belt.

In a configuration where an endless belt is rotated to move a support portion for a medium, such as the configuration of the inkjet recording device of JP-A-2014-37108, image quality may decrease because transport accuracy of the medium is low. This may occur because driving force of the rotary motor used to rotate the belt is not suitably transmitted to the support portion because, for example, the driving force is transmitted through a flexible belt. If adopting a configuration where the support portion is moved using a linear motor in order to increase the transport accuracy of the medium, it may be difficult to increase travel speed.

SUMMARY

A printing apparatus according to the present invention for solving the above-described problems includes a support portion supporting a medium, a movement unit configured to move the support portion in a movement direction, a printing unit configured to perform printing on the medium when the support portion is in a printing region, and a control unit configured to control movement of the support portion, the movement unit including a belt movement mechanism including a rotary motor and an endless belt coupled to a rotor of the rotary motor, and configured to move the support portion by rotating the endless belt through rotating the rotor, and a linear movement mechanism configured to move the support portion with a linear motor, in which, when a range in which the support portion moves in the printing region is defined as a first range and a range in which the support portion moves outside of the printing region is defined as a second range, the control unit moves the support portion with the linear movement mechanism when the support portion moves in the first range with the printing unit performing printing on the medium, and the control unit moves the support portion with the belt movement mechanism when the support portion moves within the second range.

DESCRIPTION OF EXEMPLARY EMBODIMENTS

Figure 1:
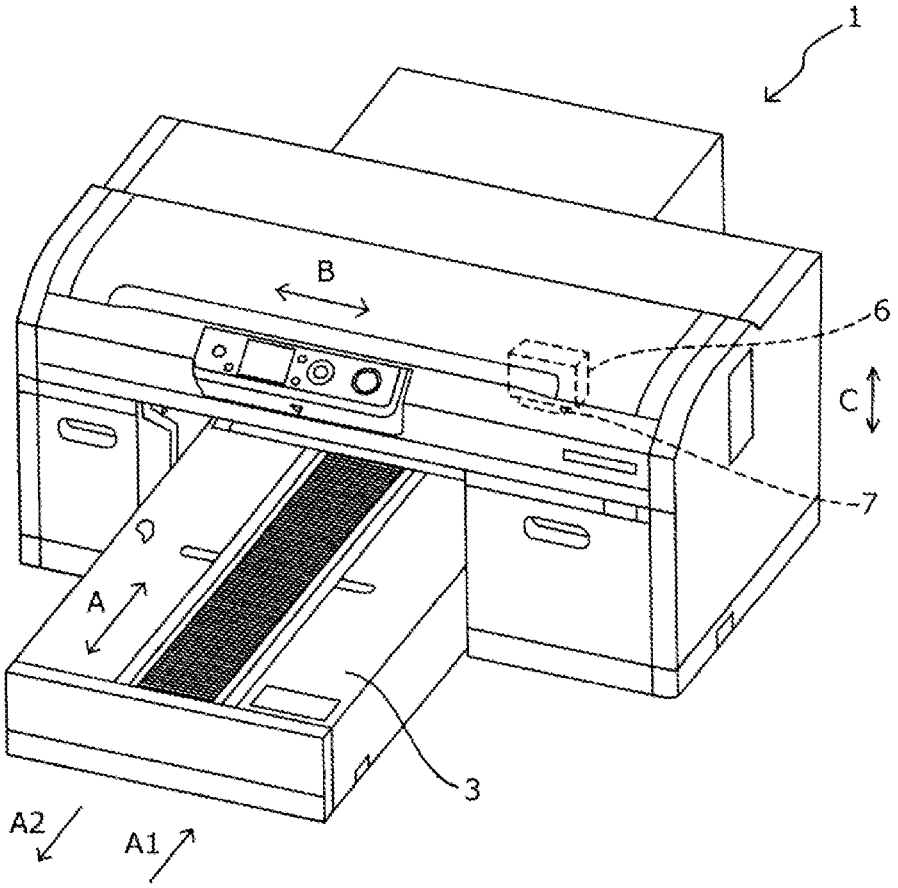
FIG. 1 is a schematic perspective view illustrating a printing apparatus according to a working example of the present disclosure.

First, the present disclosure will be schematically described.

A printing apparatus according to a first aspect of the present disclosure for solving the above-described problems includes a support portion supporting a medium, a movement unit configured to move the support portion in a movement direction, a printing unit configured to perform printing on the medium when the support portion is in a printing region, and a control unit configured to control movement of the support portion, the movement unit including a belt movement mechanism including a rotary motor and an endless belt coupled to a rotor of the rotary motor, and configured to move the support portion by rotating the endless belt through rotating the rotor, and a linear movement mechanism configured to move the support portion with a linear motor, in which, when a range in which the support portion moves in the printing region is defined as a first range and a range in which the support portion moves outside of the printing region is defined as a second range, the control unit moves the support portion with the linear movement mechanism when the support portion is to move in the first range with the printing unit performing printing on the medium, and the control unit moves the support portion with the belt movement mechanism when the support portion is to move within the second range.

According to the present aspect, the support portion is moved with the linear movement mechanism when the support portion is to move in the first range due to printing and the support portion is moved with the belt movement mechanism when the support portion is to move in the second range. As a result, the linear movement mechanism can be used to move the support portion with high transport accuracy when the support portion is in the printing region during printing, and the belt movement mechanism can be used to move the support portion at high speed when the support portion is not in the printing region. Therefore, both image quality and printing speed can be improved.

A printing apparatus according to a second aspect of the present invention is the printing apparatus according to the first aspect, in which the control unit moves the support portion with the belt movement mechanism when the support portion is to move in the first range without the printing unit performing printing on the medium.

According to this aspect, the support portion is moved with the belt movement mechanism when the support portion is to move in the first range without printing being performed. Therefore, movement speed of the support portion can be particularly increased when there is no need to increase transport accuracy.

A printing apparatus according to a third aspect of the present invention is the printing apparatus according to the first aspect, in which the linear movement mechanism is provided in a region corresponding to the first range and not provided in a region corresponding to the second range.

According to this aspect, the linear movement mechanism is provided in a region corresponding to the first range and not provided in a region corresponding to the second range. In other words, the linear movement mechanism is provided only in a region required for the support portion to move in the first range. In general, the linear movement mechanism is more costly than the belt movement mechanism. Therefore, the cost of the printing apparatus can be reduced by reducing the range of movement of the medium support portion with the linear movement mechanism.

A recording device according to a fourth aspect of the present disclosure is the printing apparatus according to any one of the first to third aspects, in which the belt movement mechanism is provided in a region corresponding to the second range and further provided in a region corresponding to the first range.

According to this aspect, the belt movement mechanism is provided in a region corresponding to the second range and further provided in a region corresponding to the first range. As a result, the support portion can be moved with the belt movement mechanism when the support portion is to move in the first region without printing being performed. Therefore, movement speed of the support portion can be particularly increased when there is no need to increase transport accuracy.

A printing apparatus according to a fifth aspect of the present invention is the printing apparatus according to any one of the first to fourth aspects, further including a detector configured to detect a position of the support portion in the movement direction, in which a detection range of the detector is a range corresponding to the first range.

According to this aspect, the range in which the detector included in the printing apparatus detects the position of the support portion in the movement direction is a range corresponding to the first range. As a result, the support portion can be moved while the detector detects the support portion and transport accuracy of the support portion in the first range can be improved.

A printing apparatus according to a sixth aspect of the present invention is the printing apparatus according to any one of the first to fifth aspects, further including a guide portion extending in the movement direction of the support portion and configured to guide movement of the support portion, in which, when viewed from the movement direction, a cross-sectional area of the guide portion in the second range is smaller than a cross-sectional area of the guide portion in the first range.

According to this aspect, because the printing apparatus includes the guide portion that guides movement of the support portion, transport accuracy of the support portion can be increased. In addition, the guide portion is configured such that the cross-sectional area of the guide portion in the second range is smaller than the cross-sectional area of the guide portion in the first range when viewed from the movement direction. As a result, movement of the support portion in the movement direction can be prevented from being impeded by the guide portion.

A moving method for a support portion according to a seventh aspect of the present disclosure is a moving method for a support portion in a printing apparatus including a support portion supporting a medium, a movement unit configured to move the support portion in a movement direction, and a printing unit configured to perform printing on the medium when the support portion is in a printing region, the movement unit including a belt movement mechanism including a rotary motor and an endless belt coupled to a rotor of the rotary motor, and configured to move the support portion by rotating the endless belt through rotating the rotor, and a linear movement mechanism configured to move the support portion with a linear motor, the method including the steps of, when a range in which the support portion moves in the printing region is defined as a first range and a range in which the support portion moves outside of the printing region is defined as a second range, using the printing unit to move the support portion with the linear movement mechanism when the support portion is to move in the first range with the printing unit performing printing on the medium, and using the control unit to move the support portion with the belt movement mechanism when the support portion is to move in the second range.

According to this aspect, the support portion is moved with the linear movement mechanism when the support portion is to move in the first range due to printing being performed and the support portion is moved with the belt movement mechanism when the support portion is to move in the second range. As a result, the linear movement mechanism can be used to move the support portion with high transport accuracy when the support portion is in the printing region during printing, and the belt movement mechanism can be used to move the support portion at high speed when the support portion is not in the printing region. Therefore, both image quality and printing speed can be improved.

Hereinafter, a printing apparatus 1 according to a working example of the present disclosure will be described in detail with reference to the appended drawings.

Figure 2:
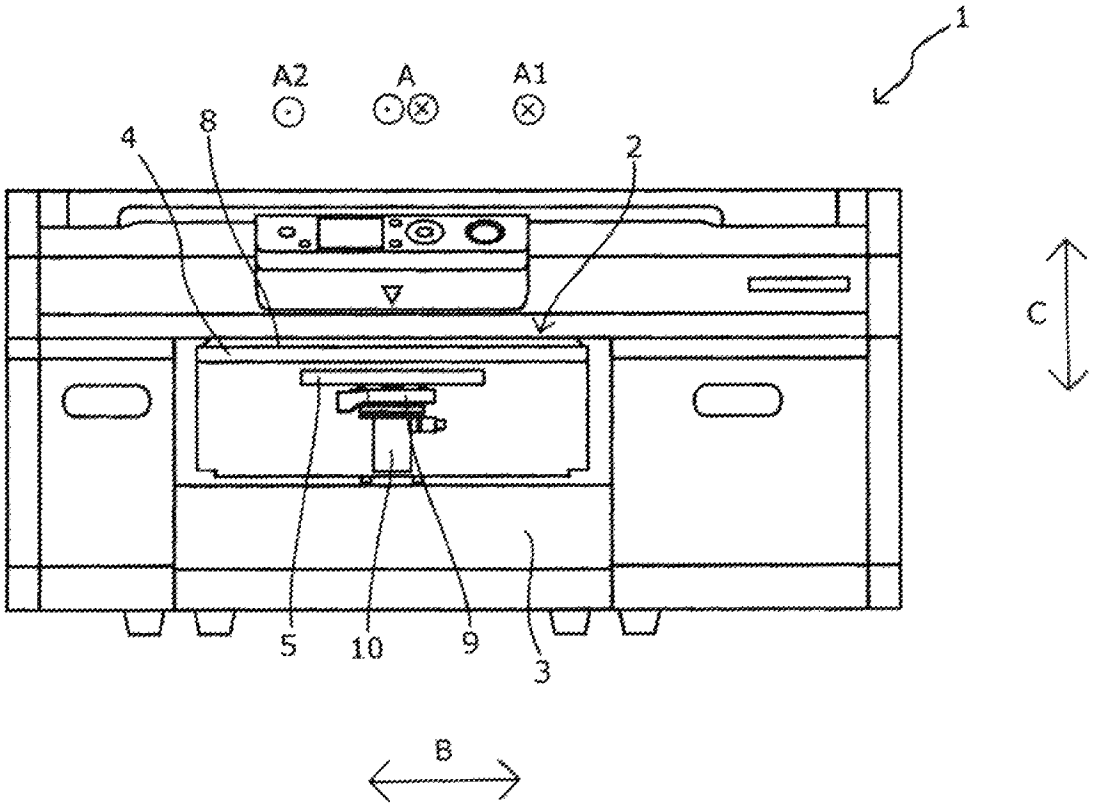
FIG. 2 is a schematic front view illustrating a printing apparatus according to a working example of the present disclosure.
Figure 3:
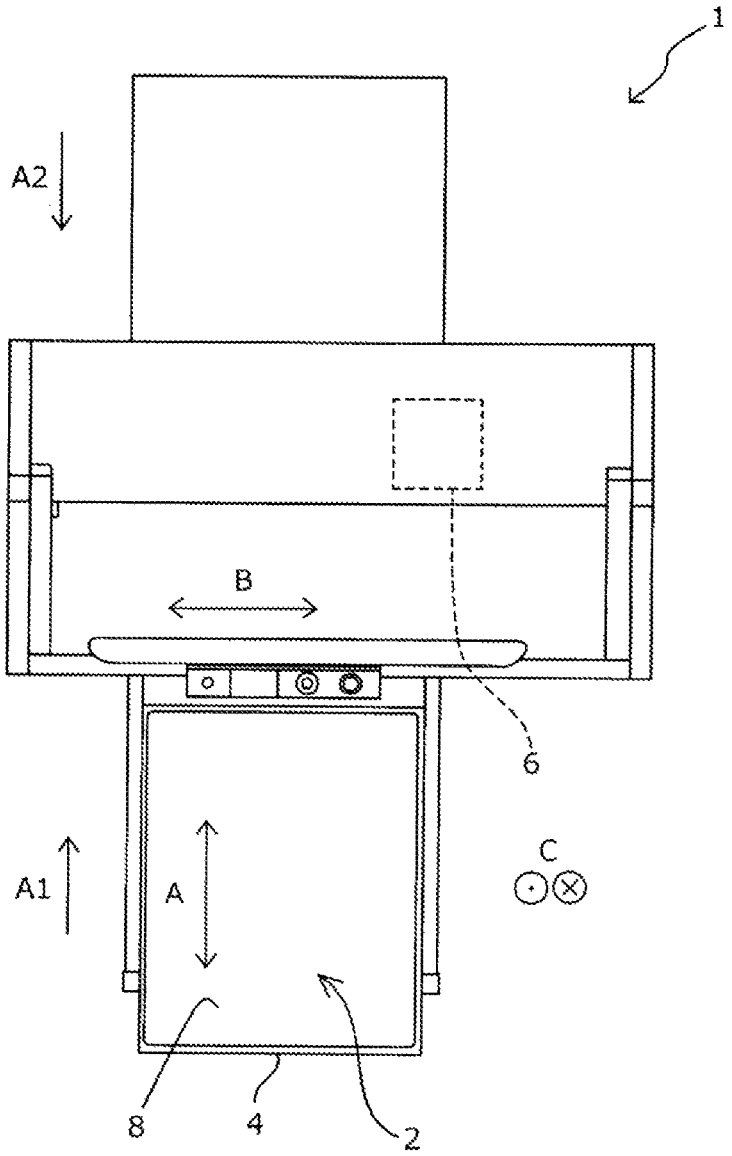
FIG. 3 is a schematic plan view illustrating a printing apparatus according to a working example of the present disclosure.

First, an outline of the printing apparatus 1 according to the present working example will be described with reference to FIGS. 1 to 3. Note that some component elements are illustrated in a simplified manner in FIGS. 1 to 3. FIG. 1 is a schematic perspective view of the printing apparatus 1. FIG. 2 is a schematic front view of the printing apparatus 1. FIG. 3 is a schematic plan view of the printing apparatus 1.

Specifically, the printing apparatus 1 according to the present working example is an inkjet printer. The printing apparatus 1 includes a medium support unit 2 serving as a support portion that moves in a movement direction A while supporting a medium. The medium support unit 2 includes a tray 4 that supports the medium on a support face 8. The printing apparatus 1 includes a medium transport unit 3 serving as a movement unit that transports the medium supported by the tray 4 in the movement direction A. The movement direction A is a direction including a direction A1 and a direction A2 opposite from the direction A1. The tray 4 is detachably placed on a tray placement portion 5. Here, an attachment/detachment direction C in which the tray 4 is attached/detached to/from the tray placement portion 5 corresponds to a vertical direction in the printing apparatus 1 according to the present working example. A lever 9 is a component that adjusts the height of the tray 4, namely, the distance between the tray 4 and a printing head 7. Rotating the lever 9 causes the tray 4 to move with the tray placement portion 5 in the vertical direction, which is a direction along the attachment/detachment direction C. Note that, as illustrated in FIG. 2, the lever 9 is provided on an arm portion 10 of the medium support unit 2. A variety of materials can be used as the medium. Examples thereof include textiles such as fabric and cloth, paper, and vinyl chloride resin. Note that the medium support unit 2 may be formed of a plurality of component members as in the present working example, or may be integrally formed as one component member.

Figure 6:
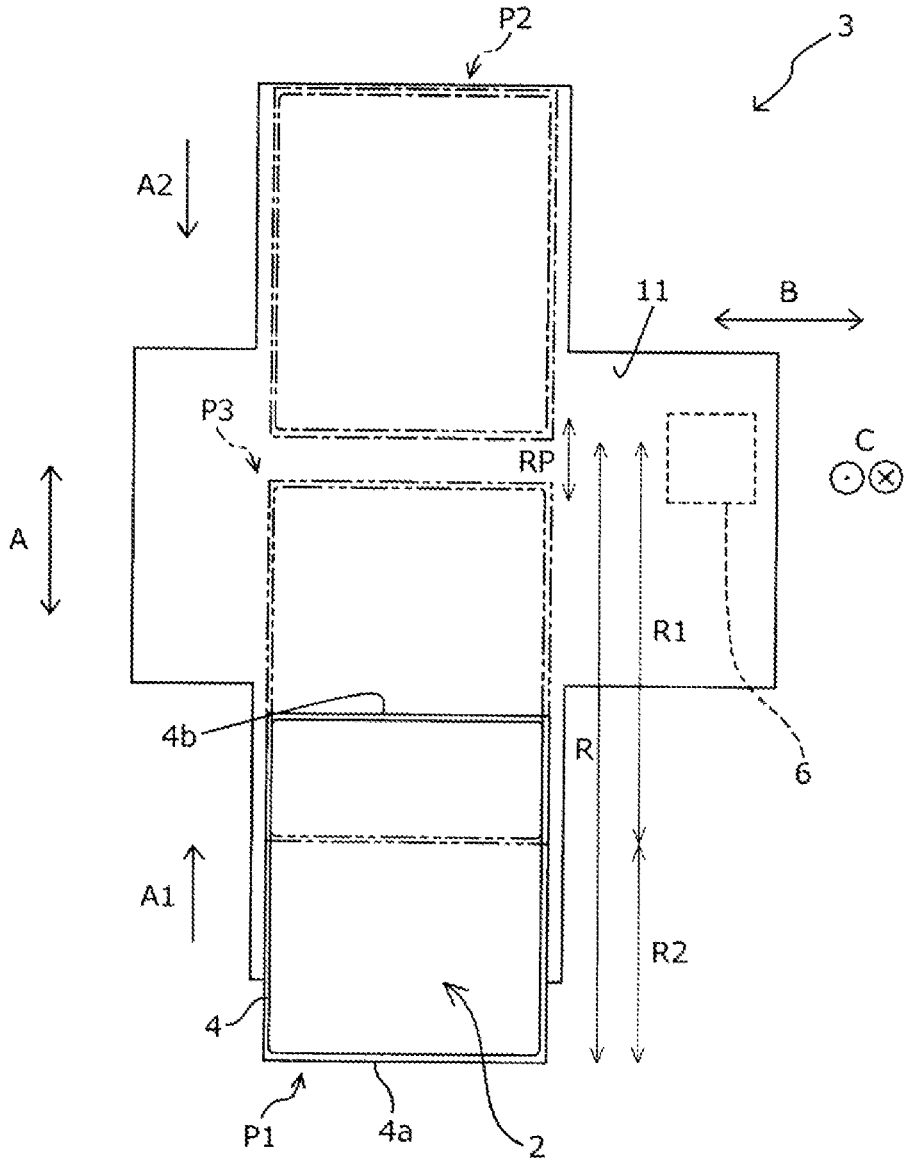
FIG. 6 is a schematic plan view illustrating a printing apparatus according to a working example of the present disclosure with some component members omitted.

The printing head 7 serves as a printing unit configured to eject ink, which is an example of a liquid, to form an image on a medium. The printing head 7 is provided inside the body of the printing apparatus 1. The action "form an image on a medium" may also be described as "print an image on a medium". The printing head 7 is provided with a nozzle (not shown) and ink is ejected from the nozzle. Note that the ink is supplied to the printing head 7 from a plurality of ink cartridges, with one ink cartridge being provided for each color. The printing apparatus 1 according to the present working example is configured to cause a carriage 6 provided with the printing head 7 to reciprocate in a scanning direction B that intersects with the movement direction A. The printing apparatus 1 forms a desired image on the medium supported by the tray 4 by ejecting ink from the printing head 7 onto the medium while causing the printing head 7 to reciprocate in the scanning direction B. At this time, a region in which the printing head 7 can form an image is referred to as a printing region RP. More specifically, the printing region RP is a region that opposes the nozzle of the printing head 7 when the carriage 6 scans and is illustrated in FIG. 6, which will be described later.

In the printing apparatus 1 according to the present working example, a front side, which is the lower-left direction in FIG. 1, corresponds to a set position P1 of the medium on the tray 4 and a rear side, which is the upper-right direction in FIG. 1, corresponds to a printing start position P2. Here, the set position P1 is a stop position of the medium support unit 2 when the medium is set on the medium support unit 2, and the printing start position P2 is a start position of the medium support unit 2 when printing on the medium starts. Note that, in the printing apparatus 1, the medium may be set on the tray 4 while the tray 4 is removed from the tray placement portion 5, and the tray 4 on which the medium is set may be mounted to the tray placement portion 5. In this case, the position at which the tray 4 set with the medium is mounted to the tray placement portion 5 corresponds to the set position P1. That is, the "set position" is a position at which the medium is directly or indirectly assembled to a mobile body configured to move in the movement direction A. In the printing apparatus 1, a printing completion position P3 is set between the printing start position P2 and the set position P1 in the movement direction A. The printing completion position P3 is the position of the medium support unit 2 when printing on the medium is complete. The specific positions of the set position P1, the printing start position P2 and the printing completion position P3 will be described later with reference to FIG. 6.

After setting a medium on the tray 4 at the set position P1, a user gives the printing apparatus 1 an instruction to start printing. In response to the instruction to start printing, the printing apparatus 1 moves the tray 4 set with the medium in the direction A1 of the movement direction A until the tray 4 moves from the set position P1 to the printing start position P2. Printing is then carried out while the tray 4 is moved in the direction A2 of the movement direction A until the tray 4 moves from the printing start position P2 to the printing completion position P3. At this time, the printing head 7 prints an image at a portion of the medium located in the printing region RP. Then, after printing is complete, the tray 4 is moved in the direction A2 from the printing completion position P3 to the set position P1. When the tray 4 returns to the set position P1 after printing is complete, the user can remove the printed medium from the tray 4.

The printing apparatus 1 according to the present working example includes the printing head 7 configured to perform printing while reciprocating in the scanning direction B. Alternatively, the printing apparatus 1 may include what is known as a line head, in which a plurality of nozzles that eject ink are provided in an intersecting direction which intersects with the movement direction of the medium.

Here, a "line head" is a printing head provided such that a region including the nozzles formed in the intersecting direction which intersects with the movement direction of the medium is able to cover the entire intersecting direction, and is used in a printing apparatus configured to form an image by moving at least one of the printing head and the medium relative to each other. Note that in the line head, the region including the nozzles in the intersecting direction may not be configured to cover the intersecting direction for all types of media that can be used in the printing apparatus.

Further, the printing head 7 according to the present working example is a printing unit configured to perform printing by ejecting ink onto a medium. However, the printing head 7 is not limited to such a printing unit and may be, for example, a transfer printing unit configured to perform printing by transferring a color material onto a medium.

Figure 4:
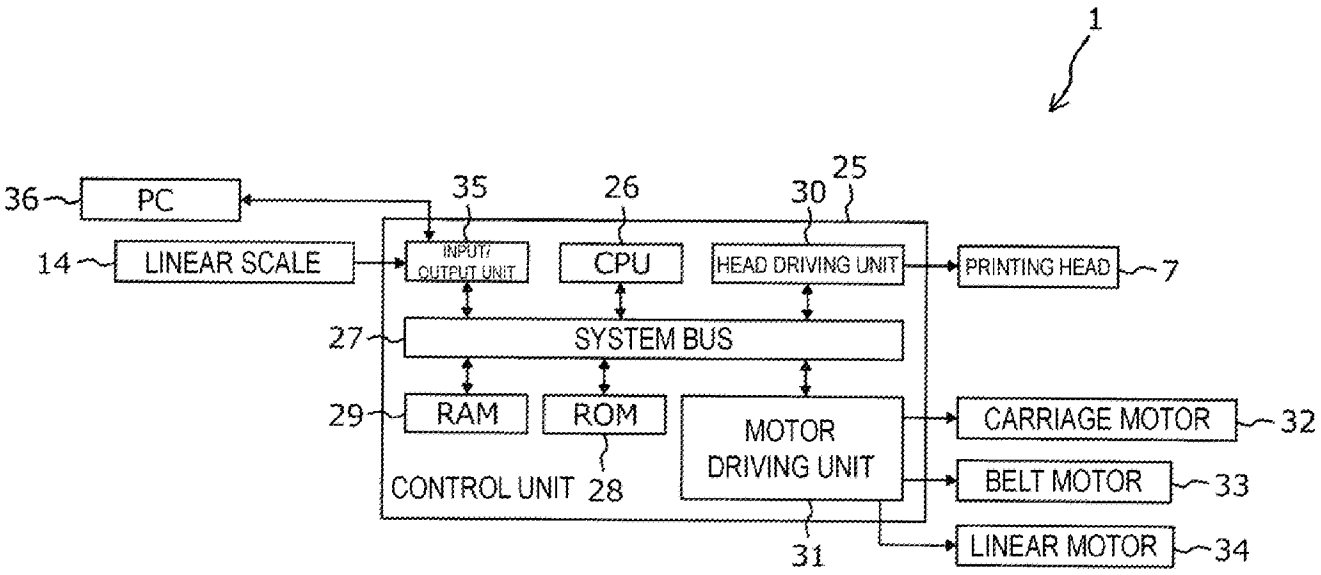
FIG. 4 is a block diagram of a printing apparatus according to a working example of the present disclosure.

Next, the electrical configuration of the printing apparatus 1 according to the present working example will be described. FIG. 4 is a block diagram of the printing apparatus 1.

The printing apparatus 1 according to the present working example includes a control unit 25 configured to control movement of the medium support unit 2 and other factors. The control unit 25 includes a CPU 26 that manages control of the entire printing apparatus 1. The CPU 26 is coupled through a system bus 27 to a ROM 28 that stores various types of control programs executed by the CPU 26 and other data, and a RAM 29 configured to temporarily store data.

The CPU 26 is also coupled through the system bus 27 to a head driving unit 30 configured to drive the printing head 7.

The CPU 26 is further coupled to a motor driving unit 31 through the system bus 27. The motor driving unit 31 is coupled to a carriage motor 32 configured to move the carriage 6 provided with the printing head 7 in the scanning direction B, a belt motor 33 configured to transport the medium, that is, move the medium support unit 2 in the movement direction A using an endless belt 12 to be described later, and a linear motor 34 to be described later.

Further, the CPU 26 is coupled to an input-output unit 35 through the system bus 27. The input-output unit 35 is coupled to a linear scale 14 and a PC 36 to be described later.

Figure 5:
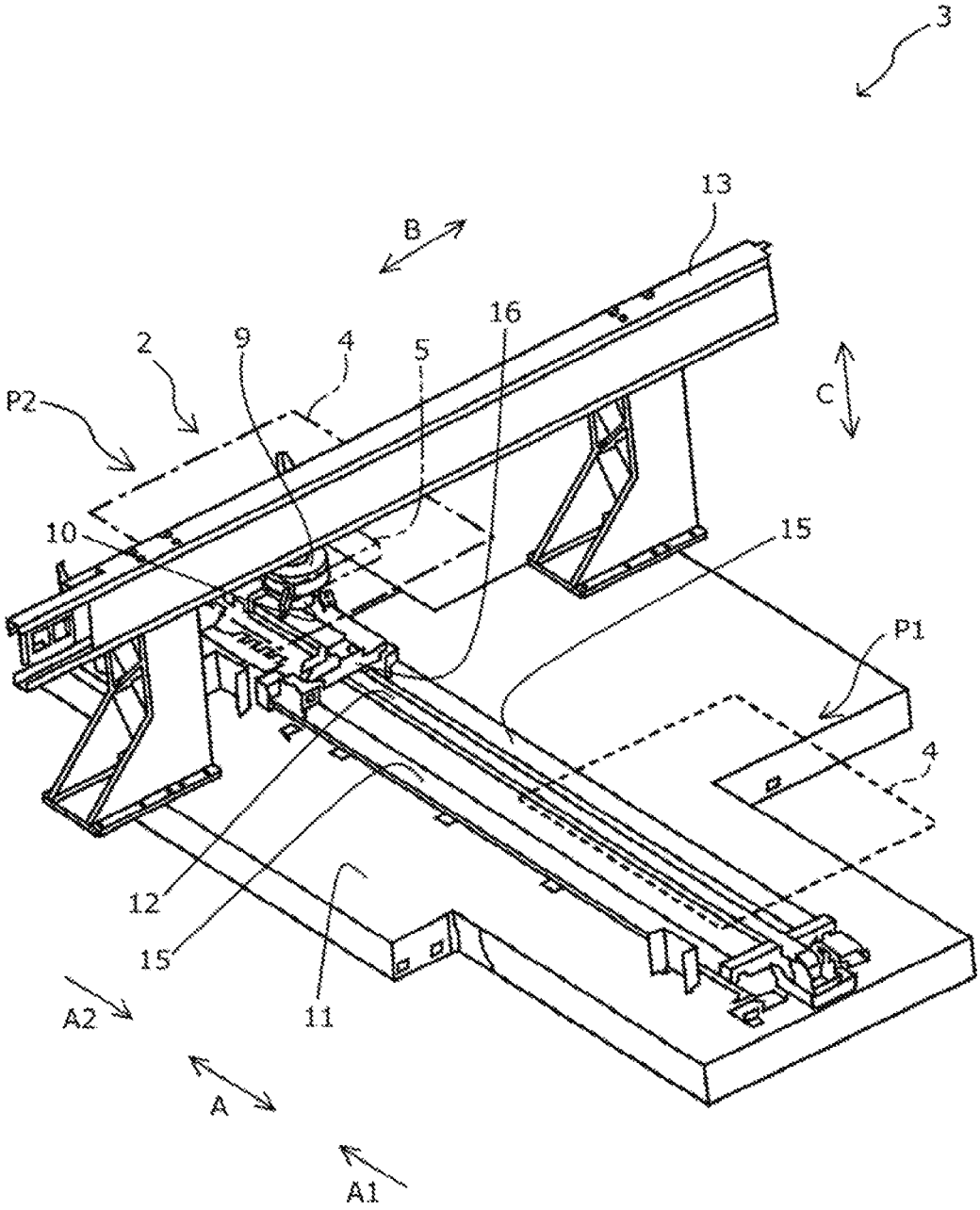
FIG. 5 is a schematic perspective view illustrating a printing apparatus according to a working example of the present disclosure with some component members omitted.
Figure 7:
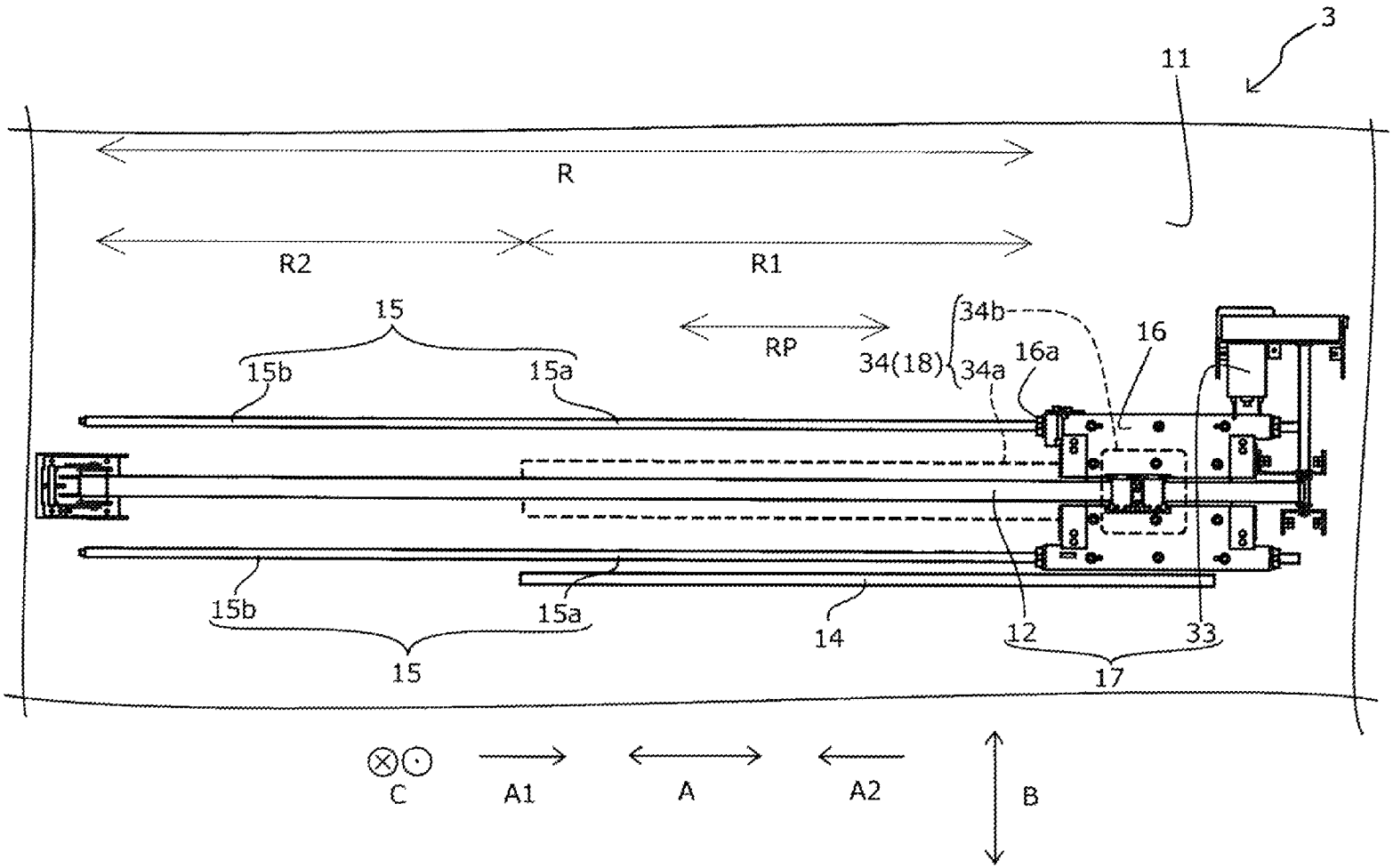
FIG. 7 is a schematic plan view illustrating a movement unit in a printing apparatus according to a working example of the present disclosure.
Figure 8:
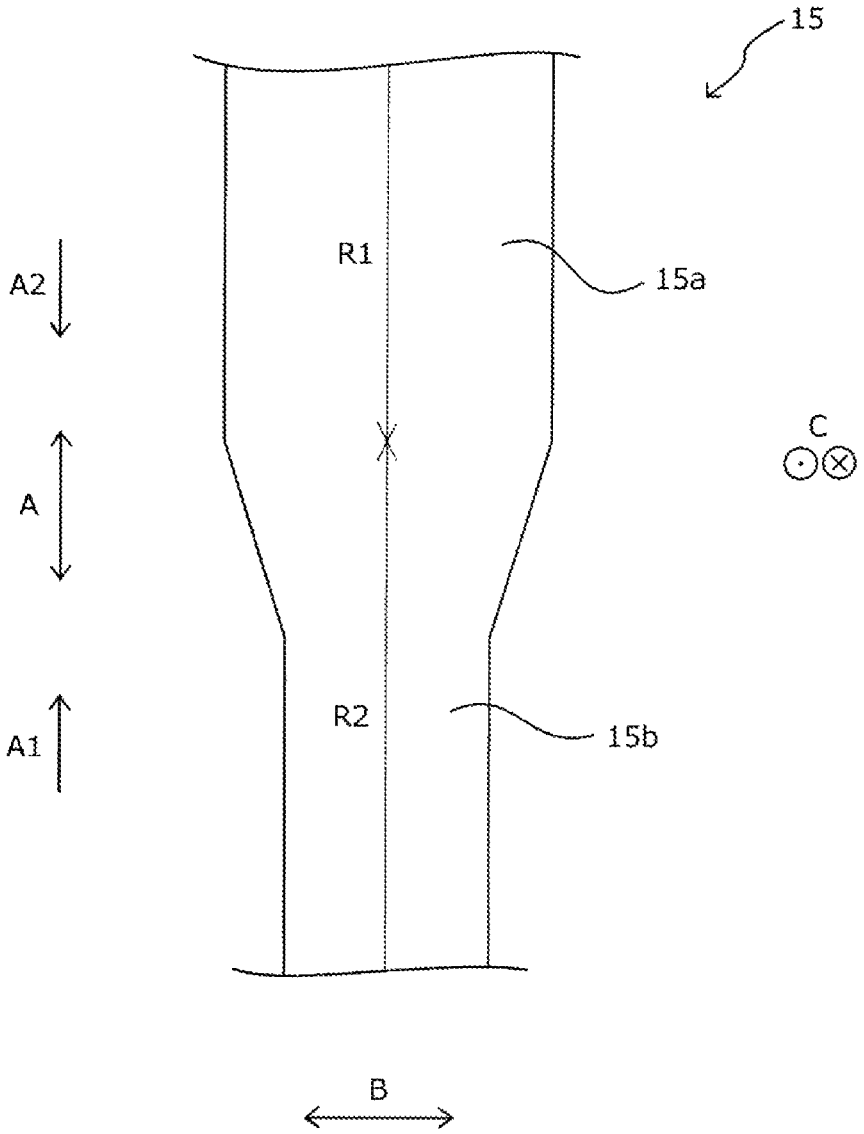
FIG. 8 is a schematic enlarged view illustrating a guide portion in a printing apparatus according to a working example of the present disclosure.

Next, the medium transport unit 3 that serves as a movement unit for the medium support unit 2 and is a main part of the printing apparatus 1 according to the present working example will be described with reference to FIGS. 5 to 8. FIG. 5 is a schematic perspective view illustrating the printing apparatus 1 with some component elements omitted. In FIG. 5, the medium support unit 2 is indicated by a dashed line when at the set position P1 and indicated by a dot-dash line when at the printing start position P2. FIG. 6 is a schematic plan view of the printing apparatus 1 with some component elements omitted. In FIG. 6, the medium support unit 2 is indicated by a solid line when at the set position P1, indicated by a dot-dash line when at the printing start position P2, and indicated by a two-dot chain line when at the printing completion position P3. FIG. 7 is a schematic plan view illustrating the medium transport unit 3 serving as a movement unit in the printing apparatus 1. FIG. 8 is a schematic enlarged view illustrating a guide portion 15 in the printing apparatus 1.

The printing apparatus 1 according to the present working example includes a frame portion 11 that functions as a base to which various members are attached. As illustrated in FIG. 5, a guide shaft 13 and the medium transport unit 3 are attached to the frame portion 11.

The guide shaft 13 extends in the scanning direction B. The carriage 6 is attached to the guide shaft 13. The carriage 6 is configured to move in the scanning direction B along the guide shaft 13. When the medium support unit 2 is located in the printing region RP, the printing apparatus 1 causes the printing head 7 to eject ink while making the carriage 6 reciprocate to print an image on a medium. Note that "when the medium support unit 2 is located in the printing region RP" refers to when at least one portion of the tray 4 between a one side end 4*a* and a other side end 4*b* of the tray 4 in the movement direction A is located in the printing region RP.

As illustrated in FIG. 5, the medium support unit 2 according to the present working example includes a stage 16 in addition to the tray 4, the tray placement portion 5, the lever 9, the arm portion 10 and other components. As illustrated in FIGS. 5 and 7, the medium transport unit 3 configured to move the medium support unit 2 in the movement direction A includes the endless belt 12 to which the stage 16 is attached, and two guide portions 15 that guide the stage 16 to move in the movement direction A. In addition, as illustrated in FIG. 7, the medium transport unit 3 includes the belt motor 33, which is a rotary motor including a rotor and configured to rotate the rotor in order to rotate the endless belt 12 coupled to the rotor. In the medium transport unit 3, the endless belt 12, the belt motor 33 and other components constitute a belt movement mechanism 17 that drives the endless belt 12 to move the medium support unit 2.

As illustrated in FIGS. 6 and 7, the medium support unit 2 is configured to move in a movement region R by the belt movement mechanism 17. The movement region R is divided into a first range R1 and a second range R2. The first range R1 is a range in which the medium support unit 2 moves in the printing region RP. The second range R2 is a range in which the medium support unit 2 moves outside of the printing region RP. Here, "range where the medium support unit 2 moves in the printing region RP" refers to a range in which the medium support unit 2 moves in the movement direction A while at least one portion of the tray 4 is in the printing region RP. In addition, "range where the medium support unit 2 moves outside of the printing region RP" refers to a range in which the medium support unit 2 moves in the movement direction A while no portion of the tray 4 is in the printing region RP. Note that the members used as a reference when indicating the movement region R, the first range R1 and the second range R2 differ in FIGS. 6 and 7. Details will be described below.

In FIG. 6, the movement region R, the first range R1 and the second range R2 are represented using the one side end 4*a* of the tray 4 in the movement direction A as a reference. When the one side end 4*a* of the tray 4 is used as a reference, the movement region R of the medium support unit 2 is a region between the position of the one side end 4*a* when the medium support unit 2 is at the set position P1 and the position of the one side end 4*a* when the medium support unit 2 is at the printing start position P2. In this case, the first range R1 is a range between the position of the one side end 4*a* when the medium support unit 2 is at the printing start position P2 and the position of the one side end 4*a* when the medium support unit 2 is at the printing completion position P3. Furthermore, the second range R2 is a range between the position of the one side end 4*a* when the medium support unit 2 is at the printing completion position P3 and the position of the one side end 4*a* when the medium support unit 2 is at the set position P1.

On the other hand, in FIG. 7, the movement region R, the first range R1 and the second range R2 are represented using a one side end 16*a* of the stage 16 in the movement direction A as a reference. When the one side end 16*a* of the stage 16 is used as a reference, the movement region R of the medium support unit 2 is a region between the position of the one side end 16*a* when the medium support unit 2 is at the set position P1 and the position of the one side end 16*a* when the medium support unit 2 is at the printing start position P2. In this case, the first range R1 is a range between the position of the one side end 16*a* when the medium support unit 2 is at the printing start position P2 and the position of the one side end 16*a* when the medium support unit 2 is at the printing completion position P3. Furthermore, the second range R2 is a range between the position of the one side end 16*a* when the medium support unit 2 is at the printing completion position P3 and the position of the one side end 16*a* when the medium support unit 2 is at the set position P1.

As illustrated in FIG. 7, the medium transport unit 3 according to the present working example includes a linear movement mechanism 18. The linear movement mechanism 18 is a mechanism configured to move the medium support unit 2 with the linear motor 34. The linear motor 34 includes a permanent magnet 34*a* provided in the frame portion 11 and an electromagnet 34*b* provided inside the stage 16. The permanent magnet 34*a* is disposed in a range corresponding to the first range R1 in the movement direction A. The motor driving unit 31 illustrated in FIG. 4 is coupled to the electromagnet 34*b* of the linear motor 34. The medium support unit 2 according to the present working example is configured to move in the first range R1 in the movement direction A by the linear motor 34. More specifically, when the control unit 25 performs control such that voltage is applied to the electromagnet 34*b*, an attractive force and a repulsive force act between the permanent magnet 34*a* and the electromagnet 34*b*, causing the medium support unit 2 to move in the movement direction A. Note that the linear motor 34 according to the present working example is formed of a permanent magnet 34*a* and an electromagnet 34*b*, but the linear motor 34 is not limited to such a configuration and, for example, may be an ultrasonic motor.

As described above, the medium transport unit 3 includes the belt movement mechanism 17 and the linear movement mechanism 18. As a result, the printing apparatus 1 according to the present working example is configured such that the medium support unit 2 can be moved with the linear movement mechanism 18 in the first range R1 and the medium support unit 2 can be moved with the belt movement mechanism 17 in both the first range R1 and the second range R2. In this case, the medium support unit 2 can be moved with either the belt movement mechanism 17 or the linear movement mechanism 18 in the first range R1. However, the control unit 25 according to the present working example moves the medium support unit 2 with the linear movement mechanism 18 if the medium support unit 2 is to move in the first range R1 as a result of the printing head 7 printing on the medium, and moves the medium support unit 2 with the belt movement mechanism 17 if the medium support unit 2 is to move in the first range R1 without the printing head 7 printing on the medium.

The phrase "if the medium support unit 2 is to move in the first range R1 due to the printing head 7 printing on the medium" specifically refers to a case where the medium support unit 2 is to be moved from the printing start position P2 to the printing completion position P3 while the printing head 7 prints on the medium. In this case, transport accuracy is desirably increased in order to improve the quality of the image to be printed. Thus, the control unit 25 uses the linear movement mechanism 18 to move the medium support unit 2 with high accuracy.

The phrase "if the medium support unit 2 is to move in the first range R1 without the printing head 7 printing on the medium" specifically refers to a case where the medium support unit 2 is to be moved from the set position P1 to the printing start position P2 without the printing head 7 printing on the medium. In this case, there is no need to consider the quality of the image to be printed, and thus movement speed of the medium support unit 2 is desirably increased. As a result, the control unit 25 uses the belt movement mechanism 17 to move the medium support unit 2 at high speed. Note that a case where the medium support unit 2 is moved from the printing start position P2 to the printing completion position P3 without the printing head 7 printing on the medium is also included in the case "if the medium support unit 2 is to move in the first range R1 without the printing head 7 printing on the medium". Such an action is performed when, for example, the medium support unit 2 has been moved to the printing start position P2 but an instruction has been issued to stop printing for some reason.

As described above, the printing apparatus 1 according to the present working example includes the medium support unit 2 configured to support a medium, the medium transport unit 3 configured to move the medium support unit 2 in the movement direction A, the printing head 7 configured to perform printing on the medium when the medium support unit 2 is in the printing region RP, and the control unit 25 configured to control movement of the medium support unit 2. The medium transport unit 3 includes the belt motor 33, which is a rotary motor, and the endless belt 12 coupled to the rotor of the belt motor 33. The medium transport unit 3 further includes the belt movement mechanism 17 for moving the medium support unit 2 by rotating the endless belt 12 through rotating the rotor, and the linear movement mechanism 18 for moving the medium support unit 2 with the linear motor 34.

In the movement region R of the medium support unit 2, the range in which the medium support unit 2 moves in the printing region RP is defined as a first range and a range in which the medium support unit 2 moves outside of the printing region RP is defined as a second range. In this case, the control unit 25 according to the present working example moves the medium support unit 2 with the linear movement mechanism 18 when the medium support unit 2 is to move in the first range R1 as a result of the printing head 7 printing on the medium and moves the medium support unit 2 with the belt movement mechanism 17 when the medium support unit 2 is to move in the second range R2. When the medium support unit 2 is moved with the linear movement mechanism 18, application of voltage to the belt motor 33 is turned off. When the medium support unit 2 is moved with the belt movement mechanism 17, application of voltage to the electromagnet 34*b* is turned off.

In other words, the above-described action can be described as a moving method for a support portion using the printing apparatus 1 according to the present working example including the medium support unit 2 that supports a medium, the medium transport unit 3 that moves the medium support unit 2 in the movement direction A, and the printing head 7 configured to perform printing on the medium when the medium support unit 2 is in the printing region R, in which the medium transport unit 3 includes the belt movement mechanism 17 including the belt motor 33, which is a rotary motor, and the endless belt 12 coupled to the rotor in the belt motor 33 and configured to move the medium support unit 2 by rotating the endless belt 12 through rotating the rotor, and the linear movement mechanism 18 configured to move the medium support unit 2 with the linear motor 34. With this moving method for a support portion, in the movement region R of the medium support unit 2, a range in which the medium support unit 2 moves in the printing region RP is defined as the first range R1 and a range in which the medium support unit 2 moves outside of the printing region RP is defined as the second range R2. When the medium support unit 2 is to move in the first range R1 as a result of the printing head 7 printing on the medium, the medium support unit 2 is moved with the linear movement mechanism 18 and, when the medium support unit 2 is to move in the second range R2, the medium support unit 2 is moved with the belt movement mechanism 17.

As described above, the printing apparatus 1 according to the present working example moves the medium support unit 2 with the linear movement mechanism 18 when the medium support unit 2 is to move in the first range R1 due to printing and moves the medium support unit 2 with the belt movement mechanism 17 when the medium support unit 2 is to move in the second range R2. Thus, the linear movement mechanism 18 can be used to increase transport speed when the medium support unit 2 is in the printing region RP when printing is performed, and the belt movement mechanism 17 can be used to move the medium support unit 2 at high speed when the medium support unit 2 is not in the printing region RP. Thus, the printing apparatus 1 according to the present working example can provide both improved image quality and improved printing speed.

In addition, the printing apparatus 1 according to the present working example can use the belt movement mechanism 17 to move the medium support unit 2 when the medium support unit 2 is to move in the first range R1 without the printing head 7 printing on the medium. Thus, if no printing is performed, that is, there is no need to increase transport speed, the printing apparatus 1 according to the present working example can move the medium support unit 2 at a particularly high speed.

As illustrated in FIG. 7, the printing apparatus 1 according to the present working example includes the linear scale 14 as a detection unit configured to detect the position of the medium support unit 2 in the movement direction A. The range in which the linear scale 14 detects the position of the medium support unit 2 is a range corresponding to the first range R1. Thus, the printing apparatus 1 according to the present working example has a configuration in which transport accuracy in the first range R1 can be particularly increased by moving the medium support unit 2 while using the linear scale 14 to detect the medium support unit 2. Note that detection accuracy tends to decrease when the detection range of the detector increases. The printing apparatus 1 according to the present working example limits the detection range to the first range R1, thereby suppressing a decrease in detection accuracy. More specifically, the linear scale 14 according to the present working example is provided only in a range corresponding to the first range R1.

As illustrated in FIGS. 5 and 7, the printing apparatus 1 according to the present working example includes the guide portion 15 that extends in the movement direction A of the medium support unit 2 and guides movement of the medium support unit 2. The guide portion 15 is a cylindrical member formed of metal and extending along the movement direction A. In the present working example, two guide portions 15 are used and each guide portion 15 is attached to the frame portion 11. Because the printing apparatus 1 according to the present working example includes the guide portion 15 configured to guide movement of the medium support unit 2 as described above, transport accuracy of the medium can be increased. Note that one guide portion 15 may be provided or three or more guide portions 15 may be provided.

In the printing apparatus 1 according to the present working example, the members constituting the first range R1 need to be positioned with high precision in order to increase the transport accuracy of the medium. To achieve this, rigidity of the members constituting the first range R1 is preferably increased. Note that "rigidity" specifically refers to bending rigidity. However, a different type of rigidity may be used as a parameter. If using a different type of rigidity, a parameter that has a large effect on deformation of each member, that is, dominant rigidity may be used as a parameter.

For the reasons described above, the frame portion 11 according to the present working example has a configuration where a reinforcing member is attached to a portion included in the first range R1 and is more rigid than the portion constituting the second range R2. Thus, the printing apparatus 1 can increase transport accuracy in the first range R1.

Next, the configuration of the guide portion 15 according to the present working example will be described in detail with reference to FIG. 8. FIG. 8 is an enlarged view of a region near the boundary between the first range R1 and the second range R2 in one of the two guide portions 15. As illustrated in FIG. 8, in the guide portion 15 according to the present working example, a region corresponding to the first range R1 is defined as a first region 15*a* and a region corresponding to the second range R2 is defined as a second region 15*b*. In this case, the first region 15*a* in the guide portion 15 is thicker than the second region 15*b*. In other words, when viewed from the movement direction A, the guide portion 15 has a configuration in which the cross-sectional area of the first region 15*a* is greater than the cross-sectional area of the second region 15*b*. Accordingly, the region corresponding to the first range R1 is more rigid than the region corresponding to the second range R2. Thus, the printing apparatus 1 can further increase transport accuracy in the first range R1.

In the printing apparatus 1 according to the present working example, the members constituting the second range R2 do not need to be positioned with high precision because high transport accuracy is not required. Thus, the members constituting the second range R2 are allowed to have lower rigidity than the members constituting the first range R1.

For the reasons described above, the frame portion 11 according to the present working example does not include a reinforcing member, such as that attached in the first range R1, at the portion included in the second range R2. As a result, the cost required to form the frame portion 11 can be reduced.

As described above, the frame portion 11 according to the present working example is configured such that the portion constituting the second range R2 is less rigid than the portion constituting the first range R1. Thus, positioning accuracy of the guide portion 15 attached to the frame portion 11 in the second range R2 tends to be lower than positioning accuracy in the first range R1. In order to deal with this impaired positioning accuracy, the guide portion 15 according to the present working example is configured such that the cross-sectional area of the second range R2 is smaller than the cross-sectional area of the first range R1 when viewed from the movement direction A. That is, as illustrated in FIG. 8, the second region 15*b* in the guide portion 15 is narrower than the first region 15*a*. In other words, the guide portion 15 has a configuration in which the cross-sectional area of the second region 15*b* is smaller than the cross-sectional area of the first region 15*a* when viewed from the movement direction A.

As illustrated in FIG. 7, two through holes are formed along the movement direction A in the stage 16 according to the present working example. The stage 16 is configured to be attached to the guide portion 15 by passing the two guide portions 15 through the two through holes. Thus, the cross-sectional area of the guide portion 15 in the second range R2 is set smaller than the cross-sectional area of the guide portion 15 in the first range R1, so that in the second range R2, a gap formed between the guide portions 15 and the through holes formed in the stage 16 is larger than the same gap in the first range R1. Thus, in the second range R2, the posture at which the guide portion 15 is attached to the stage 16 has relatively large tolerance. Therefore, even in a case where positioning accuracy of the guide portion 15 is low in the second range R2, movement of the stage 16 in the movement direction A can be prevented from being impeded by the guide portion 15. In other words, when viewed from the movement direction A, the guide portion 15 is configured such that the cross-sectional area of the guide portion 15 in the second range R2 is smaller than the cross-sectional area of the guide portion 15 in the first range R1. As a result, movement of the medium support unit 2 in the movement direction A can be prevented from being impeded by the guide portion 15.

Note that, in the guide portion 15 according to the present working example, the first region 15*a* and the second region 15*b* with different thicknesses are formed by differing the thickness of each cylindrical member partway down the member. However, the first region 15*a* and the second region 15*b* may be configured as separate members in the guide portion 15. For example, two cylindrical members having different thicknesses may be prepared and joined together to form the first region 15*a* and the second region 15*b*. Alternatively, the guide portion 15 may have a configuration in which the member constituting the first region 15*a* and the member constituting the second region 15*b* are attached to the frame portion 11 separated from each other. In other words, a gap large enough to pass over the stage 16 may be formed between the member constituting the first region 15*a* and the member constituting the second region 15*b*.

In the printing apparatus 1 according to the present working example, the belt movement mechanism 17 is provided in a region corresponding to the second range R2 and is also provided in a region corresponding to the first range R1. Thus, in the printing apparatus 1 according to the present working example, when the medium support unit 2 is to move in the first range R1 without printing being performed, the medium support unit 2 can be moved using the belt movement mechanism 17. Thus, movement speed of the medium support unit 2 can be increased when there is no need to increase transport accuracy. However, the printing apparatus 1 is not limited to this configuration and the belt movement mechanism 17 may be provided only in a region where the medium support unit 2 moves in the second range R2.

As illustrated in FIG. 7, in the printing apparatus 1 according to the present working example, the linear movement mechanism 18 is provided in a region corresponding to the first range R1 and not provided in a region corresponding to the second range R2. That is, the linear movement mechanism 18 is provided only in a region where the medium support unit 2 is required to move in the first range R1. In general, the linear movement mechanism 18 is more costly than the belt movement mechanism 17. Therefore, the cost of the printing apparatus 2 can be reduced by reducing the range of movement of the medium support unit 2 with the linear movement mechanism 18.

Note that the disclosure is not limited to the aforementioned example, and many variations are possible within the scope of the disclosure as described in the appended claims. It goes without saying that such variations also fall within the scope of the disclosure.

What is claimed is:

1. A printing apparatus comprising:

a support portion supporting a medium;

a movement unit configured to move the support portion in a movement direction;

a printing unit configured to perform printing on the medium when the support portion is in a printing region; and a control unit configured to control movement of the support portion, the movement unit including:

a belt movement mechanism including a rotary motor and an endless belt coupled to a rotor of the rotary motor, and configured to move the support portion by rotating the endless belt through rotating the rotor; and a linear movement mechanism configured to move the support portion with a linear motor, wherein when a range in which the support portion moves in the printing region is defined as a first range and a range in which the support portion moves outside of the printing region is defined as a second range, the control unit moves the support portion with the linear movement mechanism when the support portion moves in the first range with the printing unit performing printing on the medium, and the control unit moves the support portion with the belt movement mechanism when the support portion moves within the second range.

2. The printing apparatus according to claim 1, wherein the control unit moves the support portion with the belt movement mechanism when the support portion moves in the first range without the printing unit performing printing on the medium.

3. The printing apparatus according to claim 1, wherein the linear movement mechanism is provided in a region corresponding to the first range and not provided in a region corresponding to the second range.

4. The printing apparatus according to claim 1, wherein the belt movement mechanism is provided in a region corresponding to the second range and further provided in a region corresponding to the first range.

5. The printing apparatus according to claim 1, comprising:

a detector configured to detect a position of the support portion in the movement direction, wherein a detection range of the detector is a range corresponding to the first range.

6. The printing apparatus according to claim 1, comprising:

a guide portion extending in the movement direction of the support portion and configured to guide movement of the support portion, wherein when viewed from the movement direction, a cross-sectional area of the guide portion in the second range is smaller than a cross-sectional area of the guide portion in the first range.

7. A moving method for a support portion in a printing apparatus including:

a support portion supporting a medium;

a movement unit configured to move the support portion in a movement direction; and a printing unit configured to perform printing on the medium when the support portion is in a printing region, the movement unit including:

a belt movement mechanism including a rotary motor and an endless belt coupled to a rotor of the rotary motor, and configured to move the support portion by rotating the endless belt through rotating the rotor; and a linear movement mechanism configured to move the support portion with a linear motor, the method comprising:

when a range in which the support portion moves in the printing region is defined as a first range and a range in which the support portion moves outside of the printing region is defined as a second range;

moving the support portion with the linear movement mechanism when the support portion moves in the first range with the printing unit performing printing on the medium; and moving the support portion with the belt movement mechanism when the support portion moves in the second range.

* * * * *